US008083056B1

(12) United States Patent
Wu

(10) Patent No.: US 8,083,056 B1
(45) Date of Patent: Dec. 27, 2011

(54) CONTAINER

(76) Inventor: Kuo Chen Wu, Kaohsiung (TW)

( * ) Notice: Subject to any disclaimer, the term of this patent is extended or adjusted under 35 U.S.C. 154(b) by 0 days.

(21) Appl. No.: 13/046,882

(22) Filed: Mar. 14, 2011

(51) Int. Cl.
*B65D 25/08* (2006.01)

(52) U.S. Cl. ..... 206/221; 215/DIG. 8

(58) Field of Classification Search ..... 206/219, 206/221
See application file for complete search history.

(56) References Cited

U.S. PATENT DOCUMENTS 2,494,294 A * 1/1950 Greenberg ..... 206/221
2,533,806 A * 12/1950 Holzapfel ..... 206/221
2,756,129 A * 7/1956 Harris ..... 422/53
3,856,138 A * 12/1974 Maekawa et al. ..... 206/221
4,410,085 A * 10/1983 Beneziat et al. ..... 206/217
7,896,181 B1 3/2011 Francis et al.
7,931,140 B2 * 4/2011 Heidenreiter ..... 206/219

FOREIGN PATENT DOCUMENTS

TW 200936464 9/2009

* cited by examiner

*Primary Examiner* — Jacob K Ackun
(74) *Attorney, Agent, or Firm* — Alan Kamrath; Kamrath IP Lawfirm, PA

(57) ABSTRACT

A container includes a bottle, a tube, a cap and a scraping member. The bottle has a compartment and a lip portion communicating with the compartment. The tube is received in the compartment of the bottle. The cap is coupled with the tube and detachably assembled to the bottle. The scraping member is disposed at the lip portion of the bottle and has an inner circumferential edge capable of abutting against an outer circumferential wall of the tube.

21 Claims, 14 Drawing Sheets

CONTAINER

BACKGROUND OF THE INVENTION

1. Field of the Invention

The present invention generally relates to a container and, more particularly, to a container that can accommodate different substances and mix the substances when it is desired.

2. Description of the Related Art

A conventional container that can mix two beverages with different flavors is disclosed by Taiwanese Patent Publication No. 200936464 entitled "container that can accommodate different beverages". Referring to FIG. 1, the conventional container 9 comprises an outer containing portion 91, an inner containing portion 92 and a cap 93. The outer containing portion 91 comprises a protruding portion 911 therein, with the protruding portion 911 having male threads 912 on an outer circumferential face thereof. The inner containing portion 92 has female threads 921 on one end thereof for engaging with the male threads 912 of the outer containing portion 91. The cap 93 is provided to engage with both the outer containing portion 91 and the inner containing portion 92.

When the conventional container 9 is in use, the outer containing portion 91 and the inner containing portion 92 may respectively receive a first beverage and a second beverage having a different flavor from the first beverage. One can twist open the cap 93 when it is intended to drink the first and second beverages in the outer containing portion 91 and the inner containing portion 92. As the cap 93 is twisted open and removed from the outer containing portion 91, the cap 93 will force the female threads 921 of the inner containing portion 92 to separate from the male threads 912 of the outer containing portion 91, allowing the first and second beverages in the outer containing portion 91 and the inner containing portion 92 to mix. Thus, a mixed beverage with a special flavor can be provided to a consumer.

Since the inner containing portion 92 is immersed in the first beverage, a portion of the first beverage will remain on an outer circumferential face of the inner containing portion 92 when the cap 93 is twisted to separate the inner containing portion 92 from the outer containing portion 91. As a result, the first beverage attached to the outer circumferential face of the inner containing portion 92 will be carried out of the container 9 and dirty the surrounding environment. This could happen easily as the conventional container 9 is not designed with any structure capable of preventing the spill of the first beverage. The spilled first beverage not only dirties clothes or the floor, but also results in a waste of the first beverage.

Furthermore, there may exist a gap between the male threads 912 and the female threads 921. As an undesired case, the first and second beverages will mix via the gap. Overall, the conventional container 9 does not provide a desired isolation between the first and second beverages. Therefore, it is desired to improve the conventional container 9.

SUMMARY OF THE INVENTION

It is therefore the primary objective of this invention to provide a container capable of preventing the leakage of its received substance.

It is another objective of this invention to provide a container which can accommodate different substances and prevent the mixture of the substances when it is not intended to use the substances.

The invention discloses a container including a bottle, a tube, a cap and a scraping member. The bottle has a compartment and a lip portion communicating with the compartment. The tube is received in the compartment of the bottle. The cap is coupled with the tube and detachably assembled to the bottle. The scraping member is disposed at the lip portion of the bottle and has an inner circumferential edge capable of abutting against an outer circumferential wall of the tube.

Furthermore, the invention discloses a container including a bottle, a tube and a cap. The bottle has a compartment receiving a sealing plug. The tube has an opening and a positioning end on two ends thereof, with the opening tightly coupled with the sealing plug of the bottle. At least one airtight ring is disposed between the sealing plug and the opening. The cap is coupled with the positioning end of the tube and detachably assembled to the bottle, with the cap driving the opening of the tube to separate from the sealing plug when the cap is removed from the bottle.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
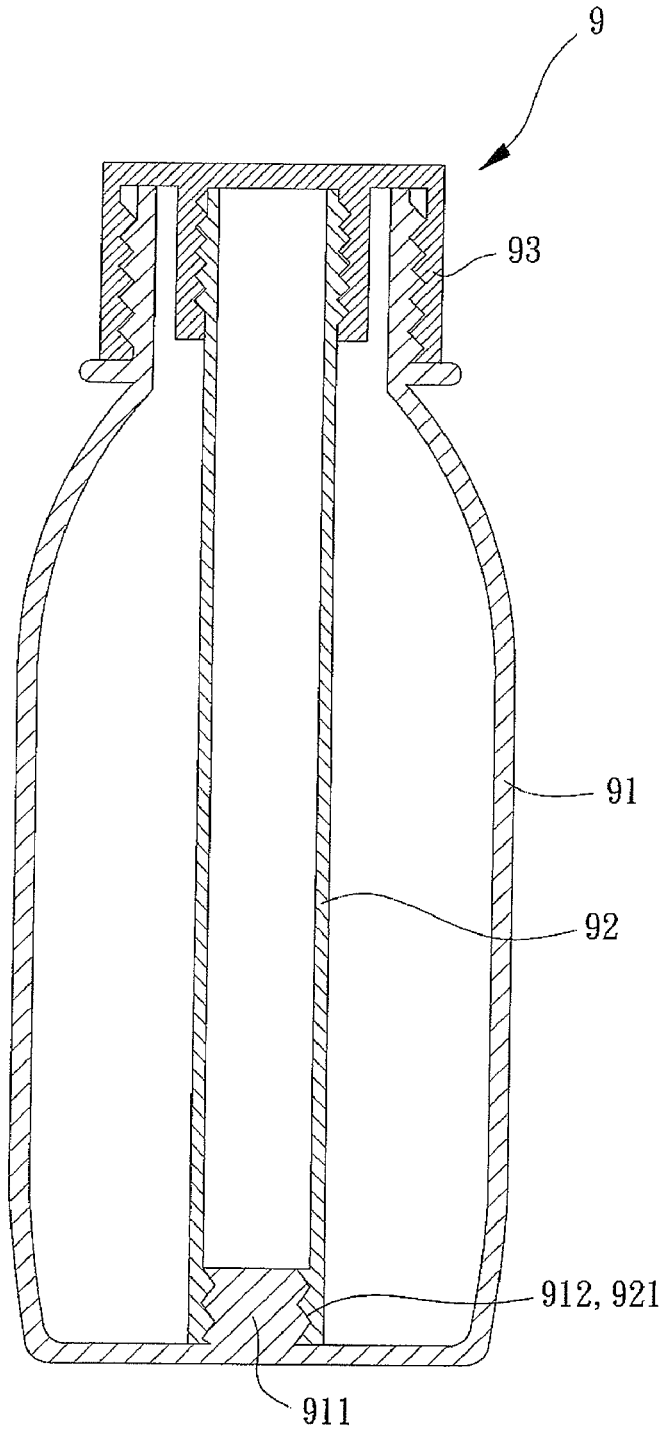
FIG. 1 PRIOR ART
FIG. 1 shows a side cross-sectional diagram of a conventional container that can mix two beverages with different flavors.

In the various figures of the drawings, the same numerals designate the same or similar parts. Furthermore, when the term "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
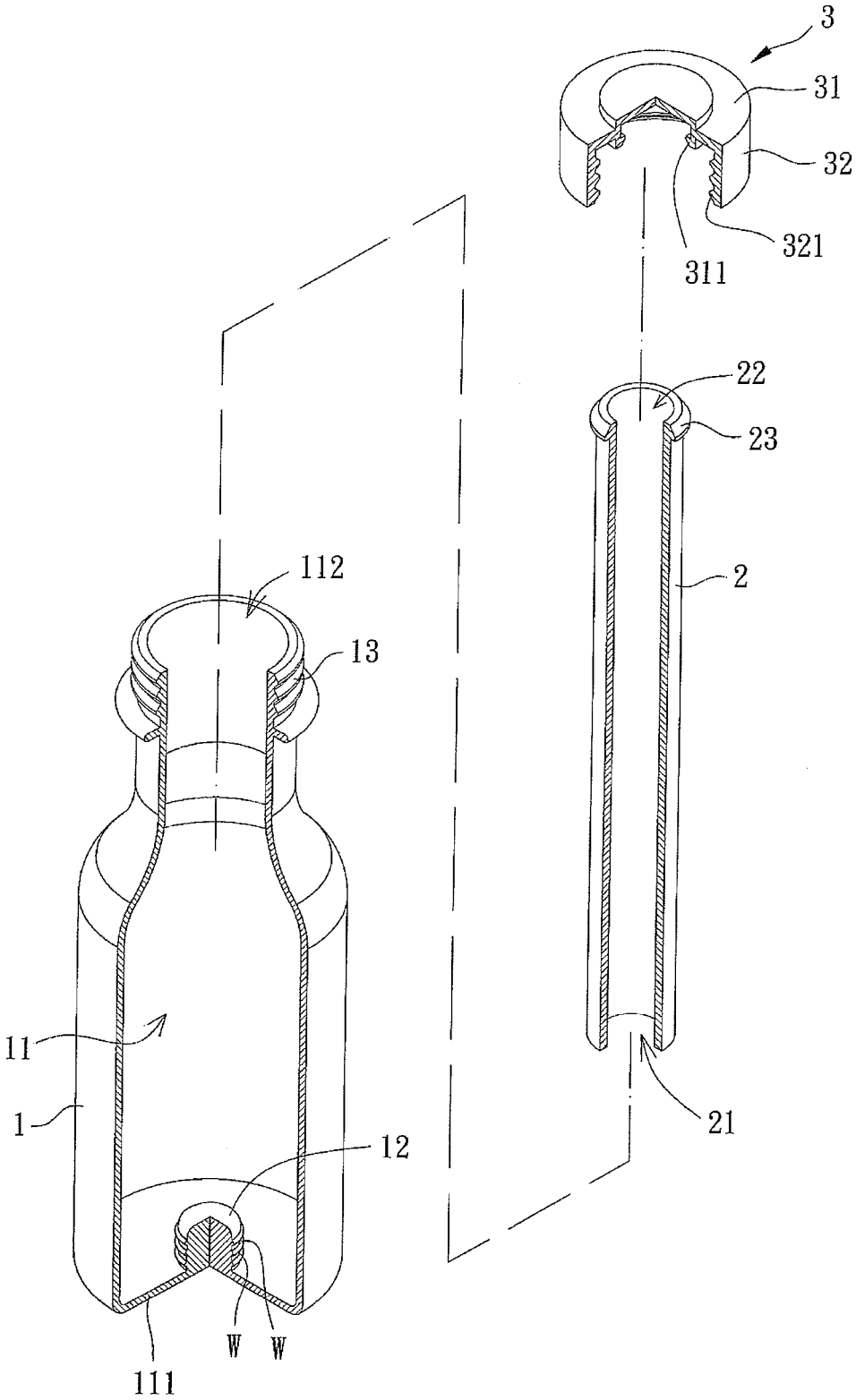
FIG. 2 shows an exploded diagram of a container according to a first embodiment of the invention.
Figure 3:
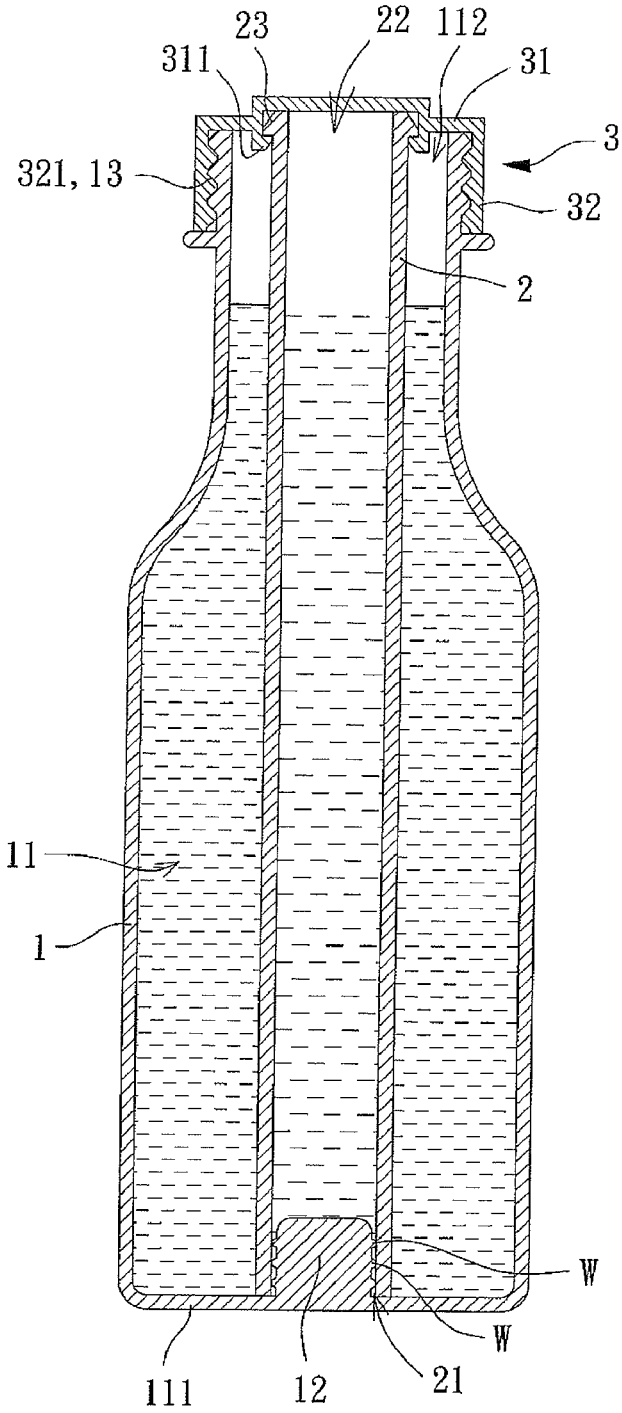
FIG. 3 shows a side cross-sectional view of the container according to the first embodiment of the invention.

Referring to FIGS. 2 and 3, a container including a bottle 1, a tube 2 and a cap 3 is disclosed according to a first embodiment of the invention. The bottle 1 is hollow, and the tube 2 is disposed in the bottle 1. The cap 3 is coupled with the bottle 1 and the tube 2.

The bottle 1 has a compartment 11 which is filled with substances that can be mixed, such as a beverage, a medicament or other substances. A sealing plug 12 is received in the compartment 11. The sealing plug 12 can be of any structure that can tightly couple with and seal off one end of the tube 2.

The bottle 1 has a base 111 on one end thereof, as well as a lip portion 112 on the other end thereof. The sealing plug 12 is disposed on the base 111, and the lip portion 112 communicates with the compartment 11. The bottle 1 further includes an outer thread portion 13 on an outer circumferential wall of the lip portion 112. The sealing plug 12 is in the form of a protruding support that can be coupled with one end of the tube 2 in a tight manner. The sealing plug 12 may be integrally formed on or assembled to the base 111.

The tube 2 may be a hollow tube with a fixed or varying outer diameter. The tube 2 has an opening 21 and a positioning end 22. The opening 21 communicates with the interior of the tube 2 and may be tightly coupled with the sealing plug 12 of the bottle 1. The positioning end 22 may be in an open or a closed form. When the positioning end 22 is in the open form (an opening), the positioning end 22 also communicates with the interior of the tube 2. Furthermore, at least one airtight ring W may be disposed between an outer circumferential wall of the sealing plug 12 and an inner circumferential wall of the opening 21. Alternatively, the least one airtight ring W may be integrally formed on the outer circumferential wall of the sealing plug 12 or on the inner circumferential wall of the opening 21 to provide convenient manufacturing.

In this embodiment, the least one airtight ring W includes a plurality of airtight rings W to provide a better sealing effect for the opening 21 of the tube 2. The airtight rings W are integrally formed on the outer circumferential wall of the sealing plug 12 in an even distance. This provides a better sealing effect of the opening 21. The tube 2 further includes an engaging protrusion 23 on an outer circumferential wall of the tube 2 at the positioning end 22, so as to couple with the cap 3. With the engaging protrusion 23, the tube 2 and the cap 3 can be securely coupled with each other. The positioning end 22 is an opening communicating with the interior of the tube 2.

The cap 3 can be coupled to and removed from the lip portion 112 of the bottle 1. Also, the cap 3 is coupled with the positioning end 22 of the tube 2 (the cap 3 may also be integrally formed on the positioning end 22 of the tube 2). When the cap 3 is twisted off the lip portion 112 of the bottle 1, the cap 3 may drive the opening 21 of the tube 2 to separate from the sealing plug 12.

In this embodiment, the cap 3 includes a base plate 31 having an annular lateral wall 32 on a periphery thereof. The base plate 31 has a hooking portion 311 that engages with the engaging protrusion 23 of the tube 2 when the cap 3 is coupled with the tube 2. As such, the cap 3 may drive the opening 21 of the tube 2 to separate from the sealing plug 12 when the cap 3 is twisted off the lip portion 112 of the bottle 1. The hooking portion 311 may be designed in any form, such as a protruding ring as shown in this embodiment. Moreover, the annular lateral wall 32 has an inner thread portion 321 on an inner circumferential wall thereof. The inner thread portion 321 is provided to engage with the outer thread portion 13 of the bottle 1.

Figure 4:
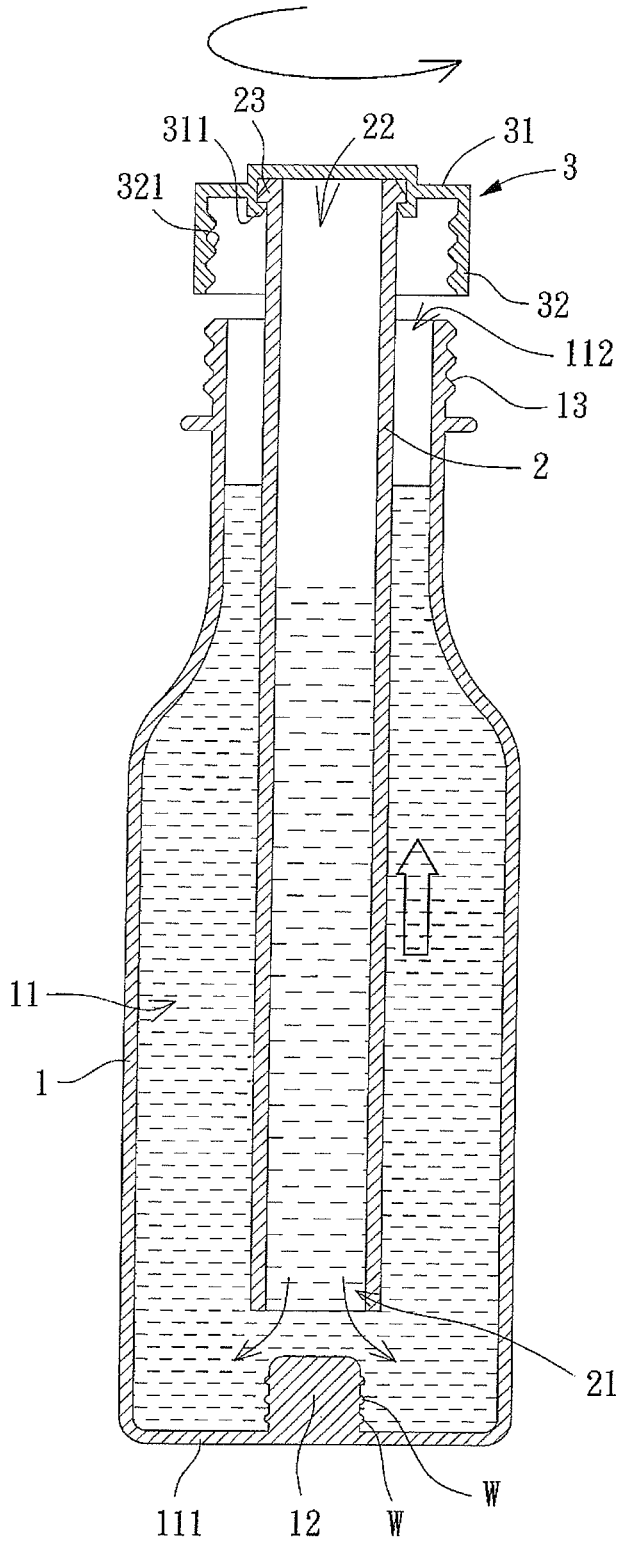
FIG. 4 shows a usage of the container of the first embodiment of the invention.

When the container is in use, the bottle 1 and the tube 2 may be filled with two different substances respectively. The two substances may be two different liquids. Alternatively, one of the two substances may be in a liquid form (such as a beverage, a medicament or other substances that can be mixed), and the other of the two substances may be in a solid form that can be mixed with or dissolved in liquid (such as pearl sago or other special powder that is edible). Referring to FIG. 4, the two substances received in the bottle 1 and the tube 2 are shown to be different beverages. When it is intended to drink the beverages in the bottle 1, one can twist the cap 3 open to disengage the inner thread portion 321 of the cap 3 from the outer thread portion 13 of the bottle 1. During twisting of the cap 3, the hooking portion 311 of the cap 3 can turn without disengaging from the engaging protrusion 23 of the tube 2. As the cap 3 is gradually twisted away from the lip portion 112 of the bottle 1, the cap 3 may simultaneously drive the opening 21 of the tube 2 to separate from the sealing plug 12 and the airtight rings W, allowing the two substances received in the bottle 1 and the tube 2 to mix. Thus, a mixed beverage with special flavor and freshness can be provided.

The container of the first embodiment of the invention is characterized in that the sealing plug 12 of the bottle 1 is coupled with the opening 21 of the tube 2 in a tight manner. With the design of the airtight rings W between the sealing plug 12 and the opening 21, the liquid in the bottle 1 can be prevented from permeating the tube 2 through the opening 21 when it is not intended to drink the beverages in the container. Thus, undesired mixture of the beverages received in the bottle 1 and the tube 2 can be avoided. Based on the tight coupling and the airtight rings W between the sealing plug 12 and the opening 21, multiple sealing mechanisms can be provided for the opening 21 of the tube 2.

Figure 5:
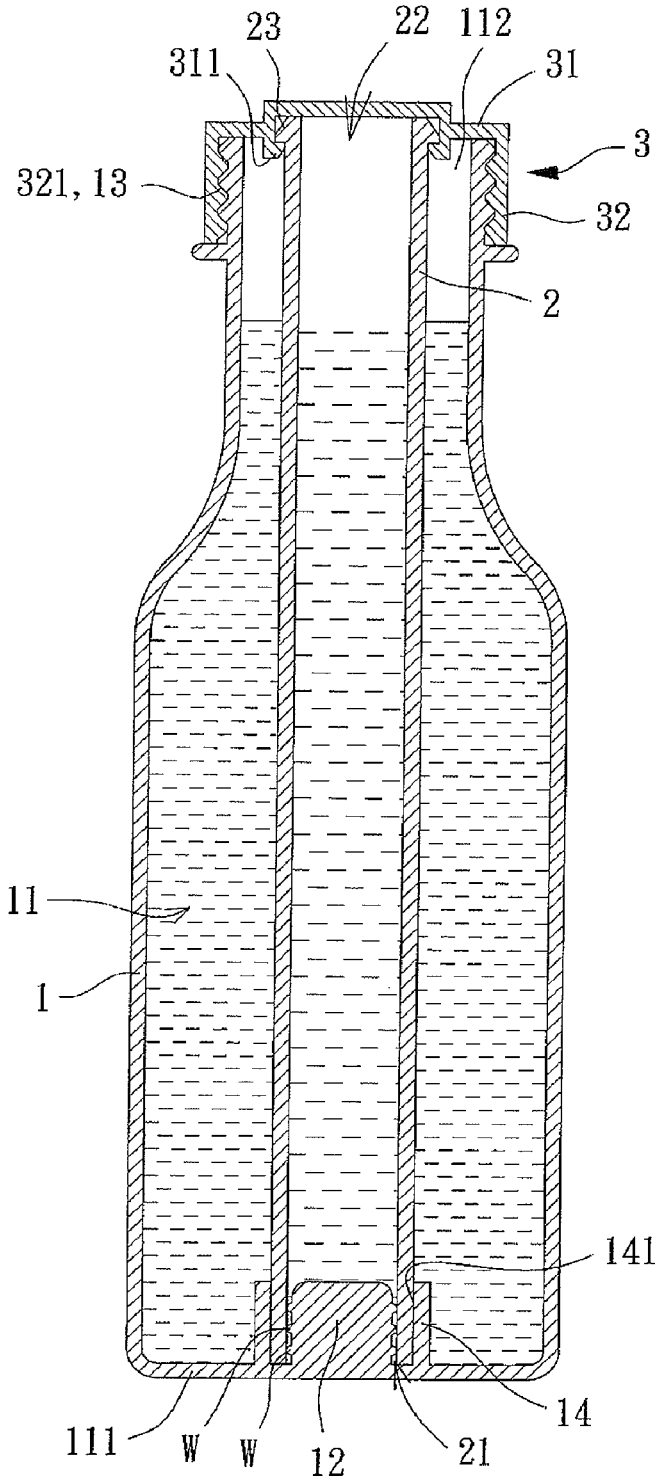
FIG. 5 shows a side cross-sectional view of a modified container of the first embodiment of the invention.

Referring to FIG. 5, the bottle 1 may further include an outer annular wall 14 surrounding the sealing plug 12. The sealing plug 12 and the outer annular wall 14 can define an annular groove 141 therebetween. Based on this, the opening 21 of the tube 2 may extend into the annular groove 141, allowing one end of the tube 2 to be clamped by the sealing plug 12 and the outer annular wall 14. Therefore, the coupling between the bottle 1 and the tube 2 may be improved. More importantly, apart from the airtight rings W between the sealing plug 12 and the opening 21, the annular groove 141 can provide an additional sealing effect for the tube 2. Thus, mixture between the liquids received in the bottle 1 and the tube 2 can be better prevented.

Figure 6:
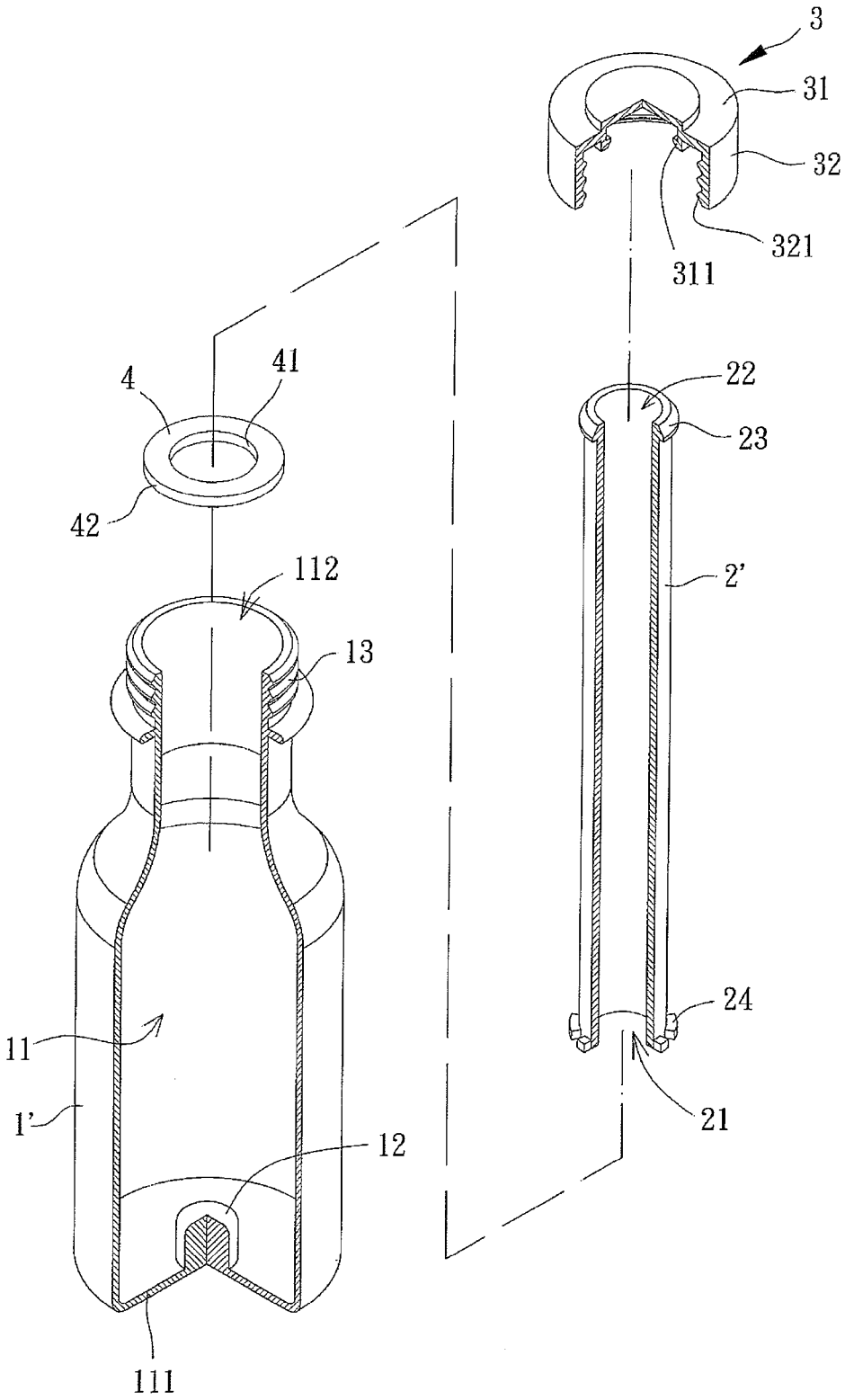
FIG. 6 shows an exploded diagram of a container according to a second embodiment of the invention.
Figure 7:
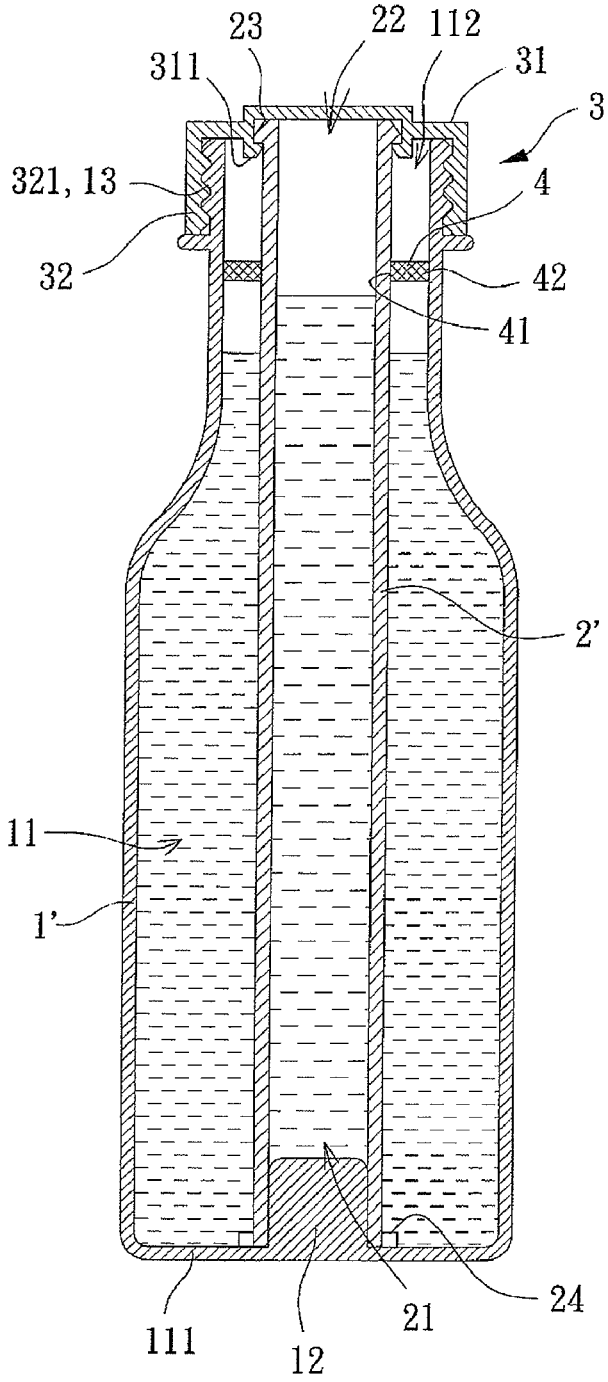
FIG. 7 shows a side cross-sectional view of the container according to the second embodiment of the invention.

Referring to FIGS. 6 and 7, a container including a bottle 1', a tube 2', a cap 3 and a scraping member 4 is disclosed according to a second embodiment of the invention. The compartment 11, the base 111, the lip portion 112, the sealing plug 12, the outer thread portion 13, the opening 21, the positioning end 22, the engaging protrusion 23, the base plate 31, the hooking portion 311, the annular lateral wall 32 and the inner thread portion 321 have been described in the first embodiment, so they are not described herein again.

Figure 11:
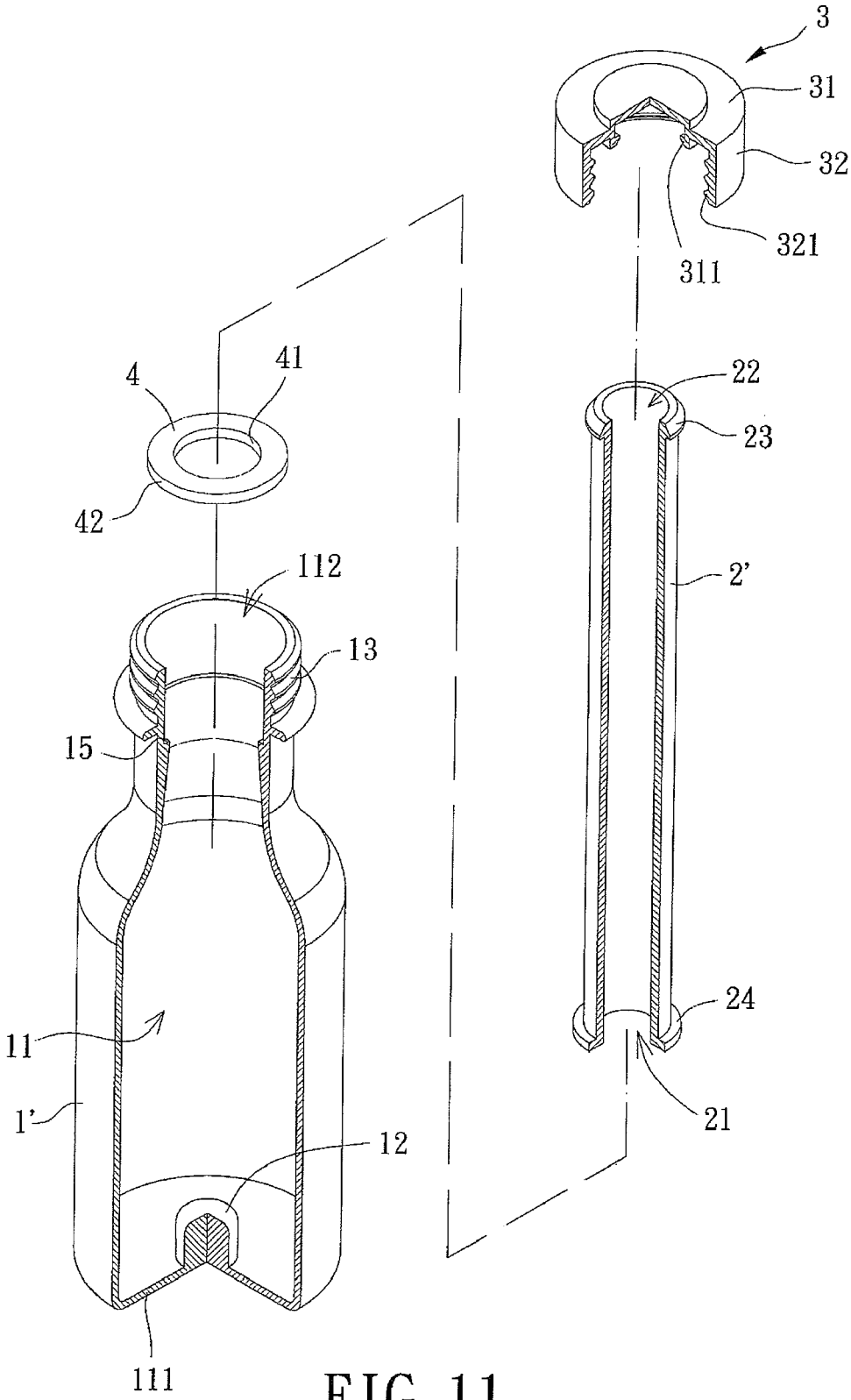
FIG. 11 shows an exploded diagram of a container having a positioning portion arranged on an inner wall of a bottle of the container according to the invention.

The container in the second embodiment differs from that in the first embodiment in that the airtight rings W between the sealing plug 12 and the opening 21 can be omitted while the desired sealing effect of the tube 2' can still be provided by the tight coupling between the sealing plug 12 and the opening 21. Furthermore, the tube 2' has a pulling portion 24 adjacent to the opening 21. In a preferred case, the pulling portion 24 is designed on a periphery of the opening 21. As shown in FIG. 6, the pulling portion 24 is in the form of a plurality of flanges extending outwards radially from the periphery of the opening 21 (or may be in the form of a protruding ring as shown in FIG. 11).

The container of the second embodiment further includes the scraping member 4 disposed on a proper position inside the bottle 1'. The scraping member 4 serves the purpose of scraping off the substance (such as liquid) attached to the outer circumferential wall of the tube 2' when the tube 2' is being pulled out of the bottle 1', preventing the substance from being carried out of the bottle 1' by the tube 2'. This avoids the substance received in the bottle 1' from spilling. Specifically, the scraping member 4 is implemented as a ring which can be made of materials such as nonwoven, aluminum foil, tinfoil, edible silicone and so on. In addition, the scraping member 4 has an inner circumferential edge 41 and an outer circumferential edge 42. The scraping member 4 can be fitted around the tube 2' via the inner circumferential edge 41. The diameter of the inner circumferential edge 41 is designed in a size conforming to an outer diameter of the tube 2', allowing the inner circumferential edge 41 to abut against the outer circumferential wall of the tube 2'. In this way, the scraping member 4 can scrape off the substance from the outer circumferential wall of the tube 2'. In other words, when the tube 2' has a fixed outer diameter, the diameter of the inner circumferential edge 41 should be equal to the outer diameter of the tube 2'. Similarly, when the tube 2' has a varying outer diameter, the diameter of the inner circumferential edge 41 should be equal to the outer diameter of the portion of the tube 2' that is immersed in the substance.

Figure 8:
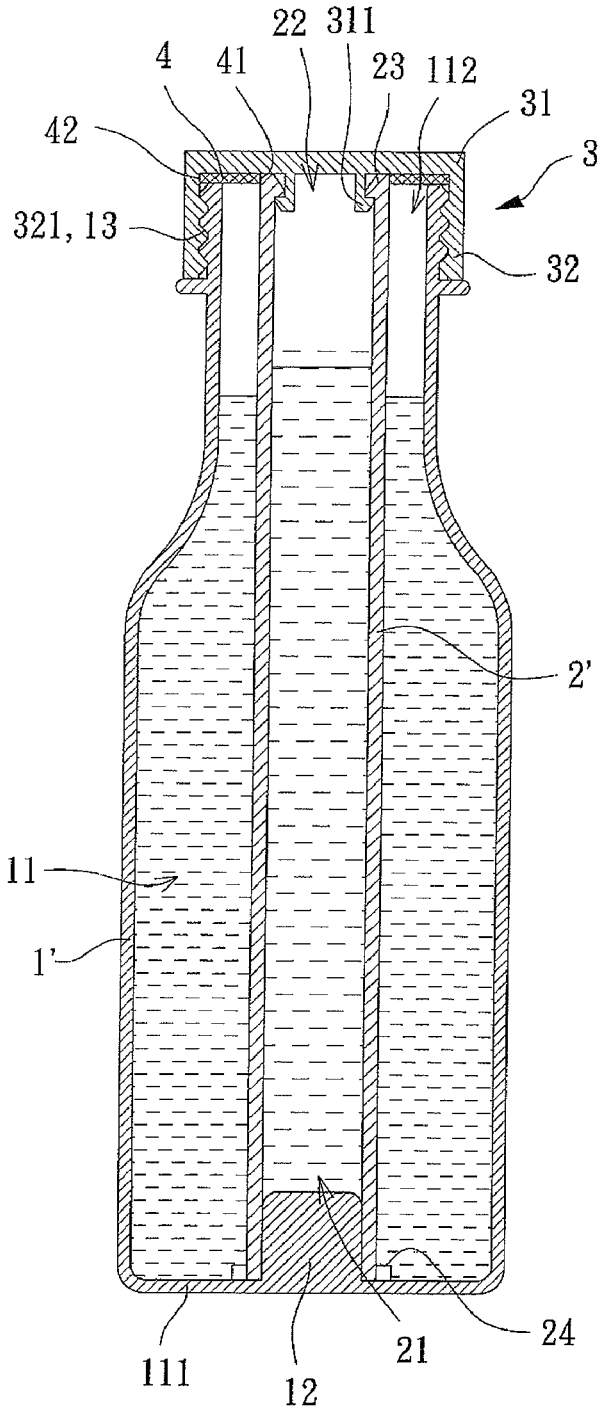
FIG. 8 shows a side cross-sectional view of a modified container of the second embodiment of the invention.

The outer circumferential edge 42 can be fixed at a proper position in the interior of the bottle 1' by way of budding, adhesion, tight fitting or less tight fitting. In the tight fitting case, the outer circumferential edge 42 is tightly fixed at the proper position of the interior of the bottle 1'. In the less tight fitting case, the outer circumferential edge 42 is tightly, but in a less extent, fixed at the proper position of the interior of the bottle 1'. For example, referring to FIG. 7, the outer circumferential edge 42 is fixed to an inner wall of the bottle 1' at the lip portion 112 by way of less tight fitting. Alternatively, referring to FIG. 8, the outer circumferential edge 42 is fixed at the inner wall of the bottle 1' at a top end of the lip portion 112 by way of adhesion. In principle, the outer circumferential edge 42 should be fixed to the inner wall of the bottle 1' in a way that the tube 2' does not easily move the scraping member 4 along the inner wall of the bottle 1' when the tube 2' is being pulled out of the bottle 1'. Since the pulling portion 24 has a larger diameter than the inner circumferential edge 41, the pulling portion 24 can pull the scraping member 4 out of the bottle 1' once the pulling portion 24 touches the scraping member 4 during pulling of the tube 2'. Therefore, it will be convenient to drink the mixed beverage in the compartment 11. However, the invention also allows the scraping member 4 to be pulled out of the bottle 1' in other manners without using the pulling portion 24.

Figure 9:
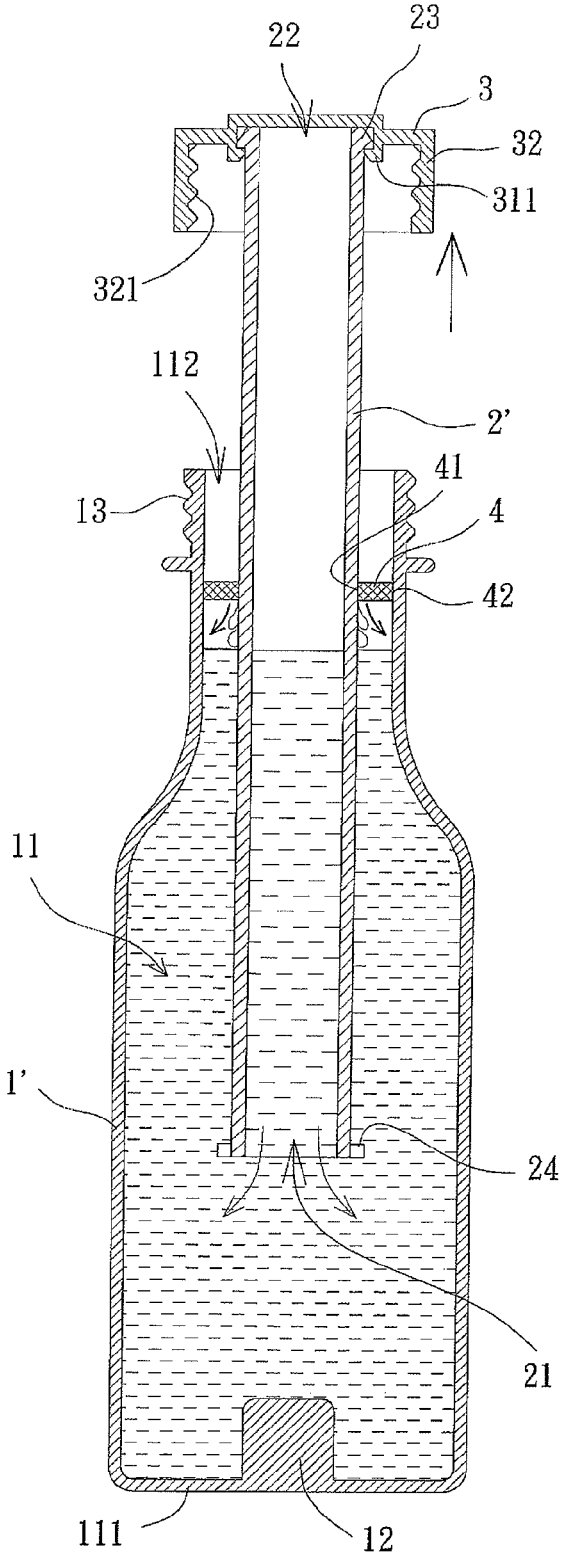
FIG. 9 shows a usage of the container of the second embodiment of the invention in which a tube of the container is being pulled out.

Referring to FIG. 9, when the container in the second embodiment is in use, the bottle 1' and the tube 2' are also able to receive different substances respectively. In this embodiment, the bottle 1' and the tube 2' are shown to receive different beverages. When it is intended to drink the beverages in the bottle 1', one should twist the cap 3 open and pull the cap 3 away from the bottle 1', driving the tube 2' to move towards the lip portion 112. This causes the opening 21 of the tube 2' to separate from the sealing plug 12 and allows the beverages in the bottle 1' and the tube 2' to mix. Since the inner circumferential edge 41 of the scraping member 4 abuts against the outer circumferential wall of the tube 2', the liquid attached to the outer circumferential wall of the tube 2' can be scraped off by the scraping member 4 during pulling of the tube 2'. As a result, the scraped liquid will fall back down to the compartment 11, preventing the liquid of the outer circumferential wall of the tube 2' from spilling out of the bottle 1'. This also avoids waste of the beverage.

Figure 10:
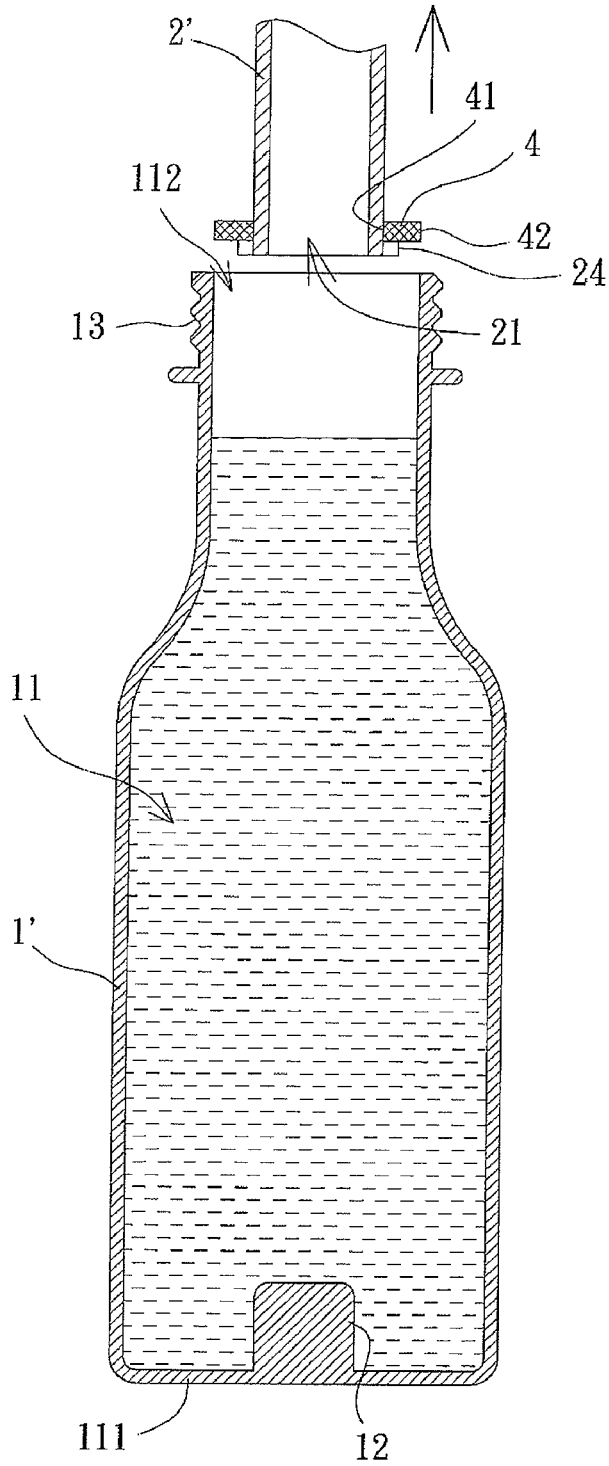
FIG. 10 shows the usage of the container of the second embodiment of the invention in which a scraping member is pulled out of the container by the tube.

Referring to FIG. 10 again, the pulling portion 24 can pull the scraping member 4 out of the bottle 1' once the pulling portion 24 touches the scraping member 4 during pulling of the tube 2'. Since the pulling portion 24 is formed on the periphery of the opening 21 at an end of the tube 2', the scraping member 4 can be finally pulled out of the bottle 1' after the scraping member 4 has completely scraped off the liquid attached to the outer circumferential wall of the tube 2', thus achieving better scraping effect.

The container of the second embodiment of the invention is characterized in fixing the scraping member 4 at the inner wall of the bottle 1' and abutting the inner circumferential edge 41 of the scraping member 4 against the outer circumferential wall of the tube 2'. This allows the inner circumferential edge 41 of the scraping member 4 to scrape off the liquid attached to the outer circumferential wall of the tube 2' during pulling of the tube 2'. In this way, there won't be any liquid attached to the outer circumferential wall of the tube 2', thus preventing the liquid from spilling out of the bottle 1'. This avoids clothes from being stained by the liquid and keeps the surrounding environment clean. Also, the waste of liquid can be prevented.

Based on the proposed structure designs of the containers of the first and second embodiments, the containers in the first and second embodiments can further include one or more of the following secondary features for further improvement, as described below.

Figure 12:
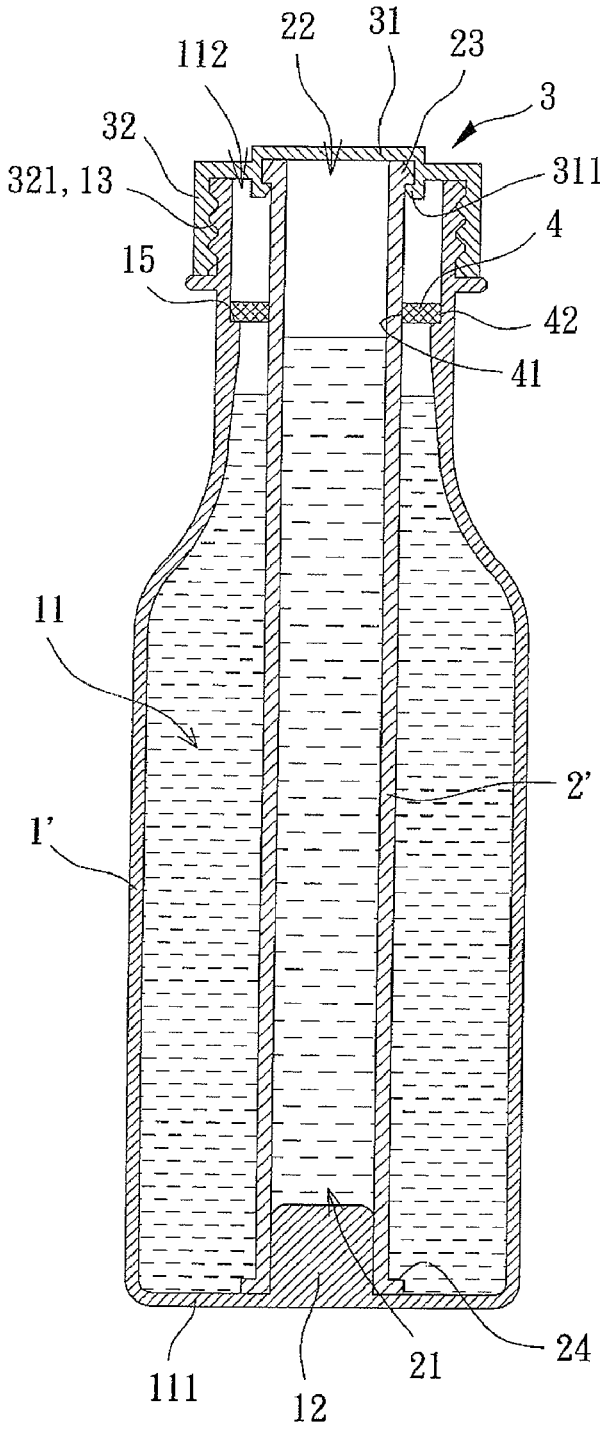
FIG. 12 shows a side cross-sectional view of the container having the positioning portion.

Referring to FIGS. 11 and 12, the container of the second embodiment is used as an example for illustration purpose. The bottle 1' further includes a positioning portion 15 on the inner wall of the bottle 1' adjacent to the lip portion 112. The positioning portion 15 serves the purpose of supporting and positioning the scraping member 4, preventing the scraping member 4 from falling into the compartment 11. In the embodiment, the positioning portion 15 is implemented as an annular shoulder portion. Thus, the liquid can be prevented from spilling out of the bottle 1', and the waste of liquid can be avoided.

Figure 13:
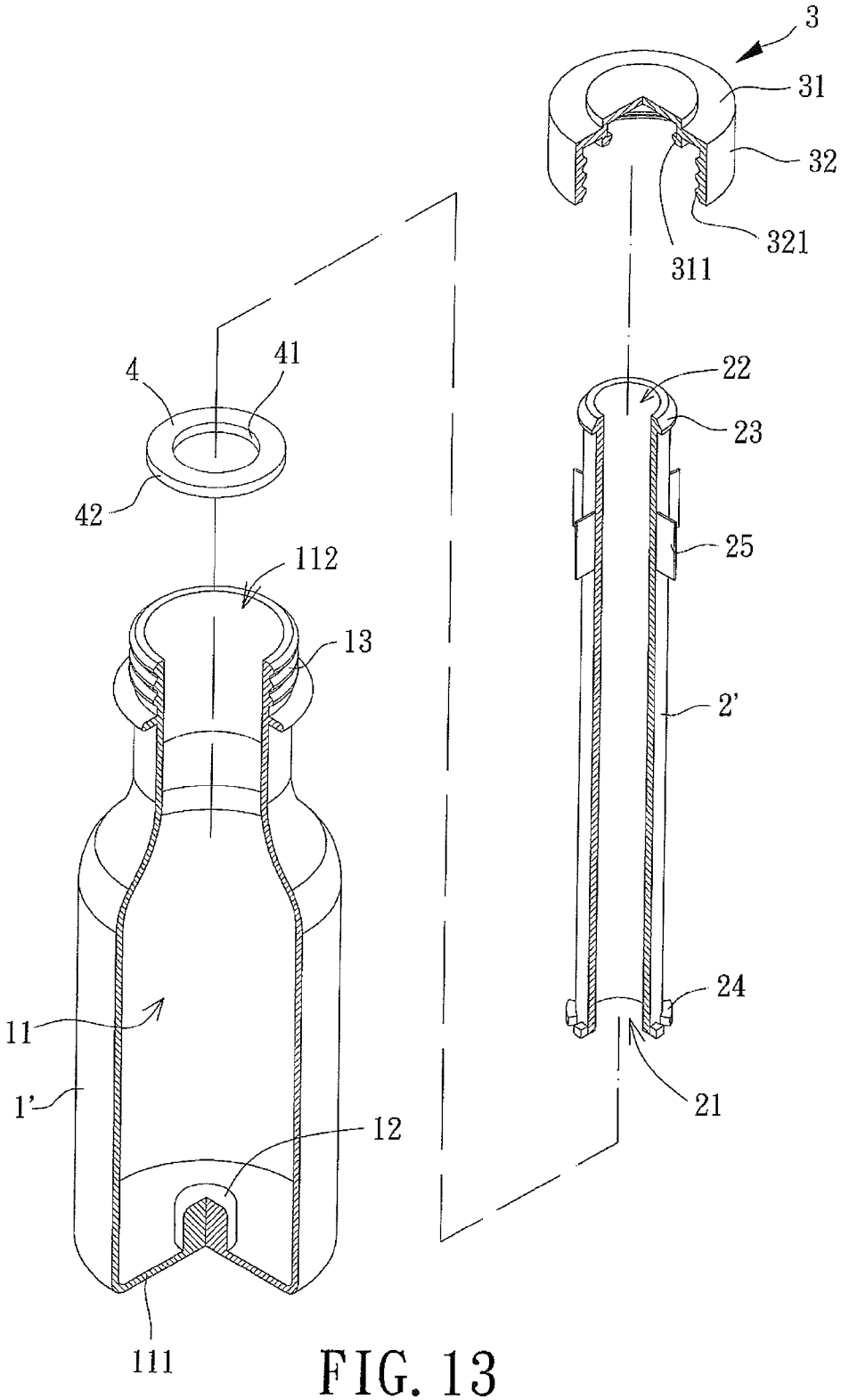
FIG. 13 shows an exploded diagram of a container including a tube having a supporting portion arranged on an outer circumferential wall thereof according to the invention.

Referring to FIG. 13, the container of the second embodiment is used as an example for illustration purpose (the same can be applied to the container in the first embodiment). The tube 2' can further include a supporting portion 25 on the outer circumferential wall thereof between the opening 21 and the positioning end 22. Preferably, the supporting portion 25 is disposed between the positioning end 22 and the scraping member 4 so that the scraping member 4 can be prevented from being pulled out of the bottle 1' by the supporting portion 25 during pulling of the tube 2'. In addition, the supporting portion 25 can be in the form of a plurality of wings or other structures with the same function. In such an arrangement, once the tube 2' leans when the tube 2' is being inserted into the compartment 11, the supporting portion 25 will touch the inner wall of the bottle 1' immediately, preventing the tube 2' from leaning. This ensures that the tube 2' can be inserted into the compartment 11 in a proper manner, thereby improving the overall assembly convenience of the bottle 1'.

Figure 14:
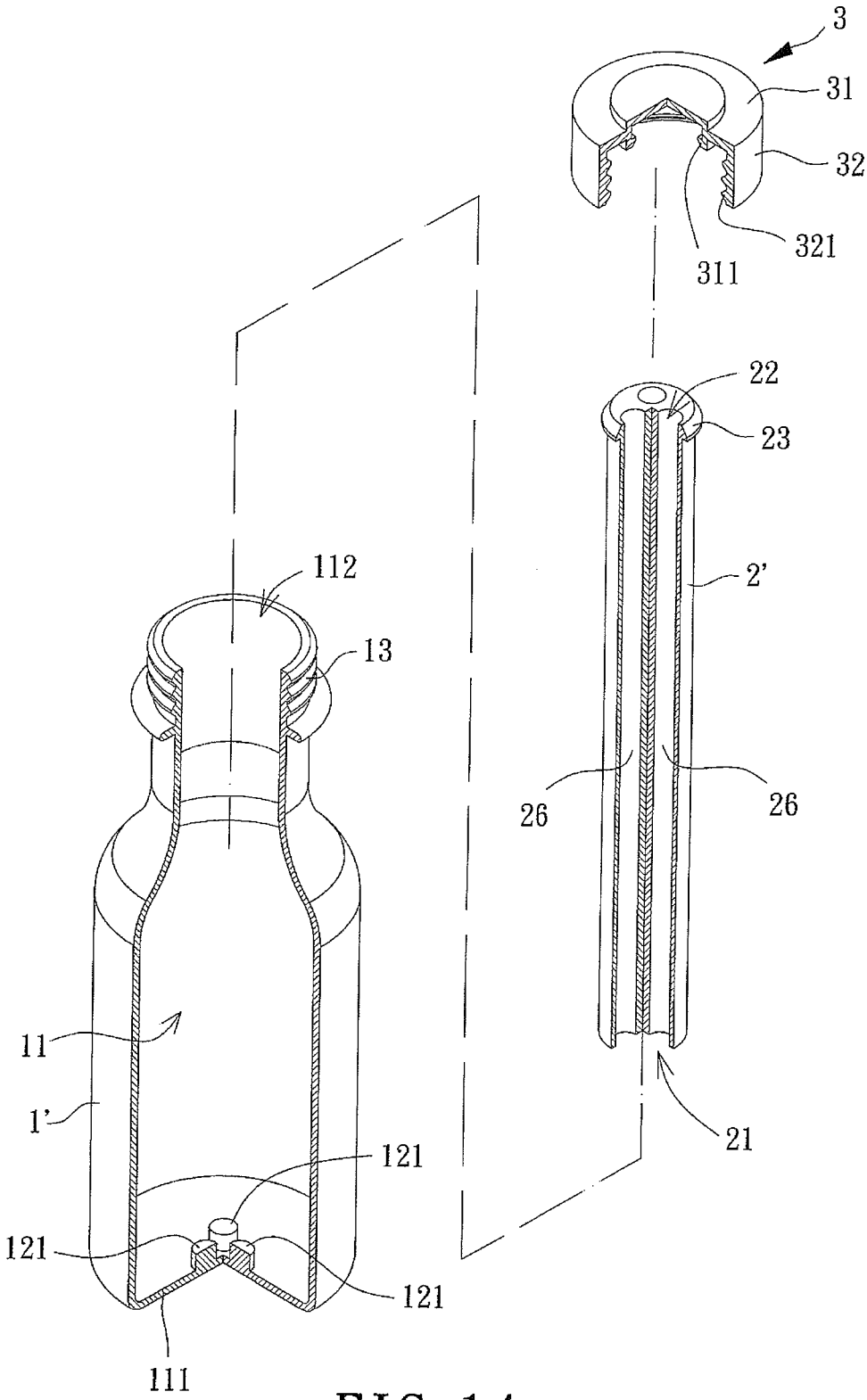
FIG. 14 shows an exploded diagram of a container including a tube having a plurality of filling holes according to the invention.

Referring to FIG. 14, the container of the second embodiment is used as an example for illustration purpose (the same can be applied to the container in the first embodiment). The sealing plug 12 of the bottle 1' is in the form of a plurality of protrusions 121. The tube 2' includes a plurality of filling holes 26. The opening 21 corresponds and communicates with opening ends of the filling holes 26. The protrusions 121 can seal the opening ends of the filling holes 26 when the opening 21 is coupled with the sealing plug 12 of the bottle 1'. In such an arrangement, the filling holes 26 can be filled with different substances, such as beverages with different flavors. Advantageously, the substance filled in the bottle 1' can mix with more kinds of substances to produce a mixed beverage with more special flavor.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A container comprising:

a bottle having a compartment, a lip portion communicating with the compartment, and a base, with the base and the lip portion on two ends of the bottle, wherein the base has a sealing plug disposed thereon;

a tube received in the compartment of the bottle, wherein the tube has an opening and a positioning end on two ends thereof, wherein the opening of the tube is tightly coupled with the sealing plug, wherein the tube further includes a pulling portion that is located on the outer circumferential wall thereof and is adjacent to the opening;

a cap coupled with the tube and detachably assembled to the bottle, wherein the positioning end is coupled with the cap; and a scraping member disposed at the lip portion of the bottle and having an inner circumferential edge abutting against an outer circumferential wall of the tube, and wherein the pulling portion has a larger diameter than the inner circumferential edge of the scraping member.

2. The container as claimed in claim 1, wherein the pulling portion is in the form of a plurality of flanges extending outwards radially from the outer circumferential wall of the tube.

3. The container as claimed in claim 1, wherein the pulling portion is in the form of a protruding ring extending outwards radially from the outer circumferential wall of the tube.

4. The container as claimed in claim 1, wherein the tube further includes an engaging protrusion on the outer circumferential wall thereof at the positioning end, and the cap has a base plate having a hooking portion engaged with the engaging protrusion of the tube.

5. The container as claimed in claim 1, wherein the sealing plug is in the form of a plurality of protrusions, the tube includes a plurality of filling holes, the opening of the tube corresponds and communicates with opening ends of the filling holes, and the protrusions seal the opening ends of the filling holes.

6. The container as claimed in claim 1, wherein the bottle further includes an outer thread portion on an outer circumferential wall of the lip portion, the cap has a base plate having an annular lateral wall on a periphery of the base plate, the annular lateral wall has an inner thread portion on an inner circumferential wall thereof, and the inner thread portion is engaged with the outer thread portion of the bottle.

7. The container as claimed in claim 6, wherein the tube further includes an engaging protrusion on the outer circumferential wall thereof at the positioning end, and the cap has a base plate having a hooking portion engaged with the engaging protrusion of the tube.

8. The container as claimed in claim 1, wherein the bottle further includes a positioning portion on the inner wall thereof, and the scraping member is disposed on the positioning portion.

9. The container as claimed in claim 1, wherein the scraping member has an outer circumferential edge coupled with an inner wall of the bottle.

10. The container as claimed in claim 1, wherein the tube further includes a supporting portion on the outer circumferential wall thereof between the opening and the positioning end.

11. The container as claimed in claim 10, wherein the supporting portion is disposed between the positioning end and scraping member.

12. A container comprising:

a bottle having a compartment including a base and a lateral wall extending from the base, wherein the bottle further includes a sealing plug and an outer annular wall surrounding the sealing plug, with the sealing plug and the outer annular wall protruding from the base, with the outer annular wall being spaced from the lateral wall;

a tube having an opening and a positioning end on two ends thereof, wherein the opening is tightly coupled with the sealing plug of the bottle, at least one airtight ring is disposed between the sealing plug and the opening; and a cap coupled with the positioning end of the tube and detachably assembled to the bottle, wherein the cap drives the opening of the tube to separate from the sealing plug when the cap is removed from the bottle, and wherein one end of the tube is clamped by the sealing plug and the outer annular wall.

13. The container as claimed in claim 12, wherein the sealing plug and the outer annular wall define an annular groove therebetween, and wherein the opening of the tube extends into the annular groove.

14. The container as claimed in claim 13, wherein the at least one airtight ring is disposed on an outer circumferential wall of the sealing plug or on an inner circumferential wall of the opening.

15. The container as claimed in claim 14, wherein the least one airtight ring includes a plurality of airtight rings integrally formed on the outer circumferential wall of the sealing plug or on the inner circumferential wall of the opening in an even distance.

16. The container as claimed in claim 12, wherein the bottle has a lip portion, with the lip portion and the base being on two ends of the bottle, and wherein the lip portion communicates with the compartment.

17. The container as claimed in claim 16, wherein the sealing plug is in the form of a protruding support.

18. The container as claimed in claim 16, wherein the sealing plug is in the form of a plurality of protrusions, wherein the tube includes a plurality of filling holes, wherein the opening of the tube corresponds and communicates with opening ends of the plurality of filling holes, and wherein the plurality of protrusions seal the opening ends of the plurality of filling holes.

19. The container as claimed in claim 16, wherein the bottle further includes an outer thread portion on an outer circumferential wall of the lip portion, the cap has a base plate having an annular lateral wall on a periphery of the base plate, the annular lateral wall has an inner thread portion on an inner circumferential wall thereof, and the inner thread portion is engaged with the outer thread portion of the bottle.

20. The container as claimed in claim 19, wherein the tube further includes an engaging protrusion on the outer circumferential wall thereof at the positioning end, and the base plate has a hooking portion engaged with the engaging protrusion of the tube.

21. The container as claimed in claim 13, wherein the tube further includes a supporting portion on the outer circumferential wall thereof between the opening and the positioning end.

* * * * *